US005996821A

United States Patent [19]

Farber et al.

[11] Patent Number: 5,996,821

[45] Date of Patent: Dec. 7, 1999

[54] MAGNETIC MEMO HOLDER

[75] Inventors: John David Farber; Hugh William Biber, both of New York, N.Y.

[73] Assignee: General Housewares Corp., Terre Haute, Ind.

[21] Appl. No.: 09/075,542

[22] Filed: May 11, 1998

[51] Int. Cl.[6] ..... A47F 5/00

[52] U.S. Cl. ..... 211/89.01; 211/45; 248/206.5

[58] Field of Search ..... 211/DIG. 1, 45, 211/89.01; 248/206.5, 316.6, 316.7; 150/150, 900

[56] References Cited

U.S. PATENT DOCUMENTS

| | | | |
|---|---|---|---|
| Re. 24,166 | 6/1956 | Stiller | 150/150 |
| D. 307,745 | 5/1990 | Adams . | |
| 2,659,169 | 11/1953 | Brennan . | |
| 2,796,068 | 6/1957 | Healy | 248/206.5 |
| 2,977,082 | 3/1961 | Harris | 248/206.5 |
| 2,978,215 | 4/1961 | Shanok et al. | 248/206.5 X |
| 3,074,193 | 1/1963 | Munson . | |
| 3,206,889 | 9/1965 | Ryan | 211/89.01 X |
| 4,287,676 | 9/1981 | Weinhaus . | |
| 4,310,978 | 1/1982 | Stern . | |
| 4,776,549 | 10/1988 | Anastos . | |
| 4,830,322 | 5/1989 | Gary | 211/89.01 X |
| 4,837,953 | 6/1989 | Tannenbaum . | |
| 4,934,304 | 6/1990 | Rosen . | |
| 4,953,714 | 9/1990 | Paul | 211/89.01 X |
| 5,156,274 | 10/1992 | Williams, Jr. et al. . | |
| 5,267,374 | 12/1993 | Drake . | |
| 5,274,937 | 1/1994 | Birnbaum . | |
| 5,377,820 | 1/1995 | Christman . | |
| 5,411,231 | 5/1995 | Buck | 248/206.5 |
| 5,425,160 | 6/1995 | Krapf . | |
| 5,613,602 | 3/1997 | Lage et al. . | |
| 5,860,573 | 1/1999 | Hossack et al. | 211/89.01 X |

*Primary Examiner*—Robert W. Gibson, Jr.
*Attorney, Agent, or Firm*—Emrich & Dithmar

[57] ABSTRACT

A magnetic holder is provided which includes a magnet and a flexible and resilient body coupled to the magnet. The body includes a slit therein defining first and second opposed lips normally resiliently biased to a closed condition. The body is responsive to compressive forces applied to predetermined locations thereon for moving the lips to an open condition spaced apart a greater distance than in the closed condition to form an opening in the body.

10 Claims, 3 Drawing Sheets

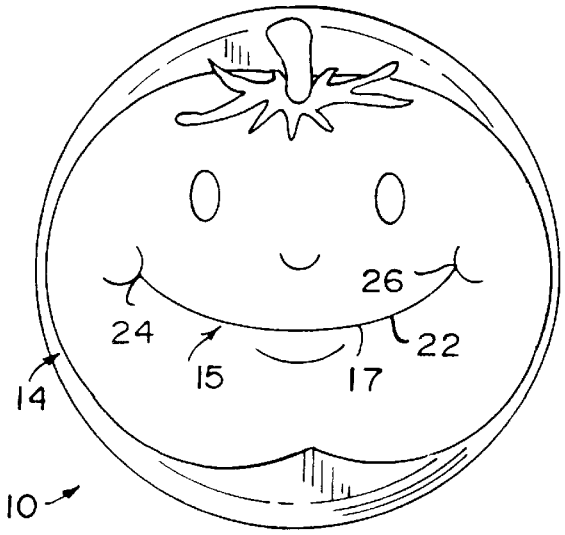
FIG. 4
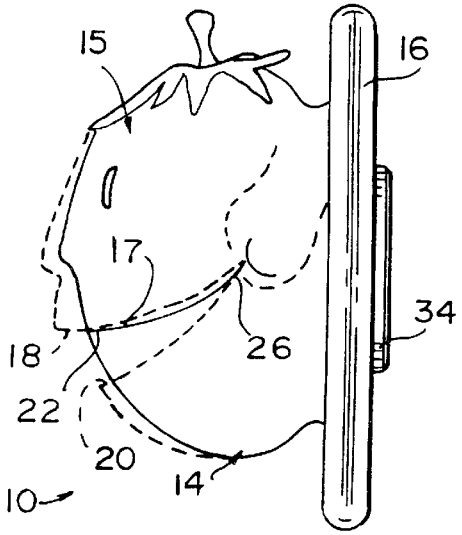
FIG. 5
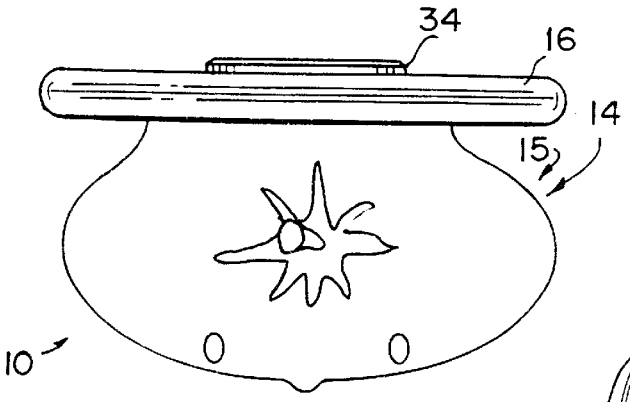
FIG..6
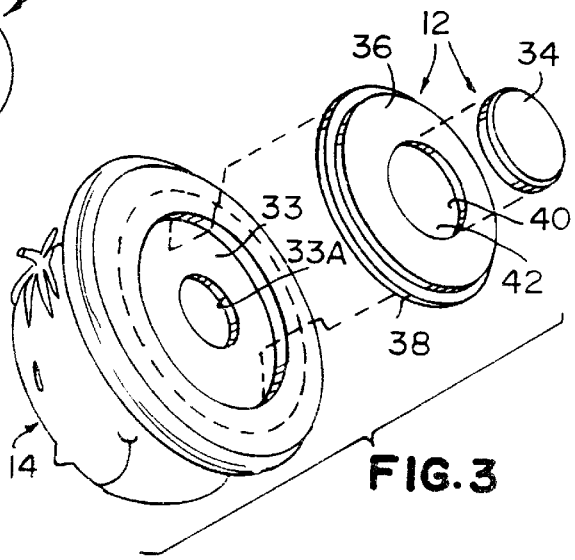
FIG.3

MAGNETIC MEMO HOLDER

BACKGROUND OF THE INVENTION

1. Field of the Invention

This invention relates to devices for holding memos or notes, and specifically to magnetic memo holders.

2. Description of the Prior Art

In the past, magnetic holders for holding memos, and the like, usually consisted of a clip component coupled to a magnet. Since these clips are multi-piece, they require assembly. Additionally, in use, the clip pieces often would separate from one another, become damaged, and be incapable of being reassembled together, thereby rendering the holder useless.

SUMMARY OF THE INVENTION

It is a general object of the invention to provide an improved magnetic holder which avoids the disadvantages of prior magnetic holders while affording additional structural and operating advantages.

An important feature of the invention is the provision of a magnetic holder which is of simple and economical structure.

A further feature of the invention is the provision of a holder of the type set forth which has a unitary body resistant to damage.

Certain of these and other features of the invention may be attained by providing a magnetic holder which includes a magnet and a flexible and resilient body coupled to the magnet. The body has a slit therein defining first and second opposed lips normally resiliently biased to a closed condition. The body is also responsive to compressive forces applied to predetermined locations thereon for moving the lips to an open condition spaced apart a greater distance than in the closed condition to form an opening in the body.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 3 is a is an exploded, rear perspective view of the magnetic holder of FIG. 1;

FIG. 4 is a front elevational view of the magnetic holder of FIG. 1;

FIG. 5 is a is a side elevational view of the magnetic holder of FIG. 1 as viewed from the right-hand side thereof;

FIG. 6 is a top plan view of the magnetic holder of FIG. 1;

DETAILED DESCRIPTION OF THE PREFERRED EMBODIMENT

Figure 1:
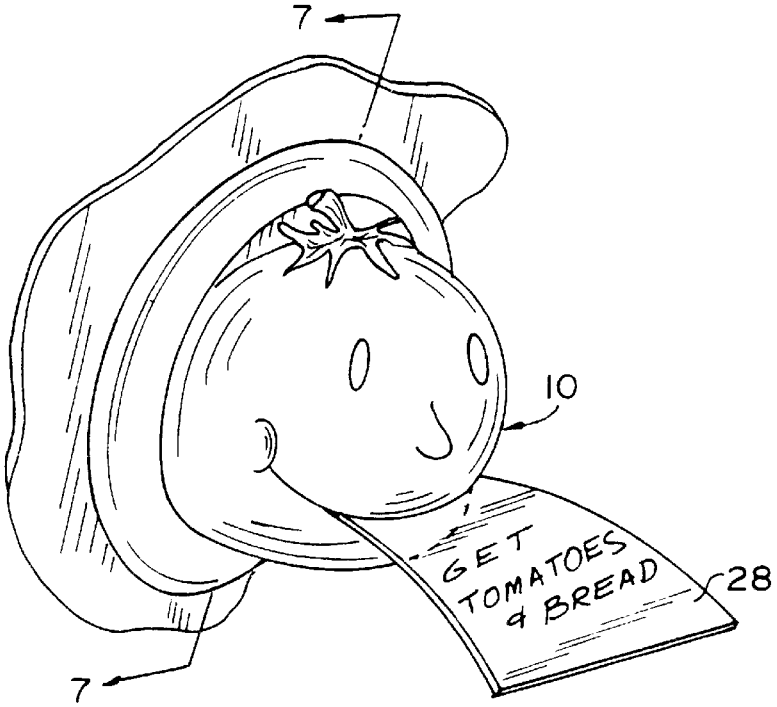
FIG. 1 is a perspective view of the magnetic holder of the present invention, mounted on a magnetizable support surface and holding an object.

Referring to FIGS. 1–7, a magnetic holder 10 includes a magnet structure 12 (FIGS. 3 and 7) and a one-piece, hollow body 14 having a head portion 15 and a base portion 16. The body 14 is preferably made out of a flexible, resilient material, such as polyvinyl chloride, rubber or latex.

The body 14 includes a slit 17 defined by first and second opposed lips 18, 20. Each of the slit 17, first lip 18 and second lip 20 is preferably non-planar (although it may be planar). As seen in FIGS. 4 and 5, the slit 17 has a center 22 and first and second ends 24, 26 disposed above the center 22. This non-planar shape provides a firmer grip on items inserted between the first and second lips 18, 20.

The first and second lips 18, 20 have a closed condition and an open condition. The material making up the body 14 resiliently biases the first and second lips 18, 20 toward each other so that the lips 18, 20 preferably contact each other in the closed condition, as in FIG. 4.

Figure 2:
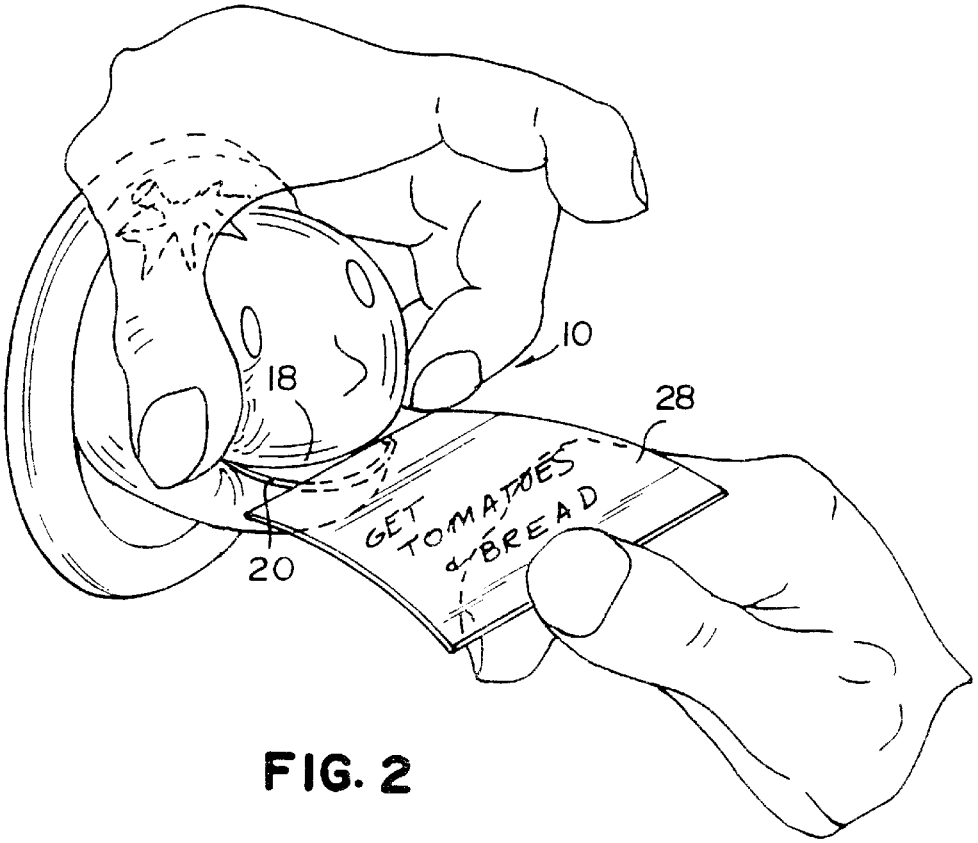
FIG. 2 is a perspective view of the magnetic holder of FIG. 1 wherein a user has moved the lips to an open condition.

Although there are several ways to separate lips 18, 20, when, as seen in FIGS. 2 and 5, compressive forces are applied to the head portion 15 of the body 14, such as near the first and second ends 24, 26 of the slit 17, the lips 18, 20 are moved to an open condition (FIGS. 2 and 4) where they are spaced apart a greater distance than in the closed condition. This spacing allows, as seen in FIG. 2, a memo or note 28 to be placed between lips 18 and 20. When a user removes the compressive forces to the head portion 15 of the body 14, the head portion 15 resiliently returns the lips 18, 20 toward their normal closed condition for gripping and holding the note 28 (FIG. 1). It should also be noted that certain rigid items can be inserted and resiliently maintained between lips 18, 20 without necessarily compressing the head portion 15.

Figure 7:
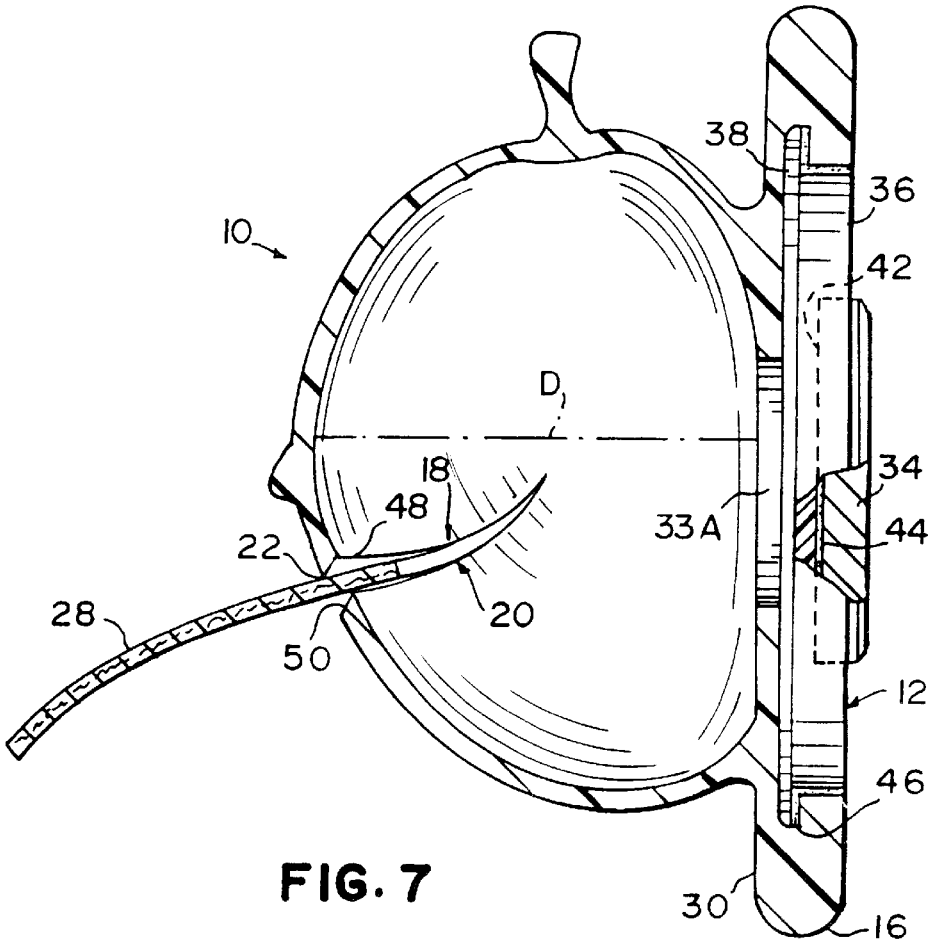
FIG. 7 is an enlarged sectional view of the magnetic holder taken generally along line 7—7 of FIG. 1.

As seen in FIGS. 5 and 6, the base 16 has a disk-like shape and a front planar surface 30 from which the head 15 projects. As seen in FIGS. 3 and 7, the base 16 also includes an annular channel 32 formed in part by a back wall 33 of the head 15 and a portion of the base 16. The back wall 33 has an aperture 33A.

The magnetic structure 12, as seen best in FIGS. 3 and 5, includes a disk-shaped magnet 34 and a circular, disk-shaped plate 36 made of a material more rigid than the material comprising the body 14, such as a hard plastic. The plate 36 includes an annular peripheral edge 38, a central portion 46 of increased thickness and a cylindrical cavity 42 in which the magnet 34 is attached via adhesive 44 or the like.

The magnetic structure 12 is coupled to the base 16 by placing the annular peripheral edge 38 in channel 32. If necessary, adhesive 46 can be placed between the base 16 and plate 36 to facilitate coupling. When the magnetic structure 12 is coupled to the base 16, the holder 10 can be placed and held on a magnetizable metal surface, such as a refrigerator.

As seen in FIG. 7, the first and second lips 18 and 20 respectively have surfaces 48, 50 parallel to each other.

Surfaces 48 and 50, however, are preferably not perpendicular to the planar surface 30 of the base 16.

Additionally, the slit 17 has a length "L" as measured between its first and second ends 24 and 26 along the edge of the lips 18, 20 and the body 14 has a depth "D", as seen in FIG. 7, as measured on a line perpendicular to planar surface 30 and extending between planar surface 30 and the center 22 of slit 17 when the lips 18 and 20 are in their closed condition. The ratio of the length of the slit 17 to the depth of the body 14 (L/D) in the illustrated embodiments is less than about 2:1 although other ratios are possible. The length and depths of the slit 17 can vary allowing the lips 18, 20 to grip and accommodate, among other things, letter sized paper and legal sized envelopes.

Figure 8:
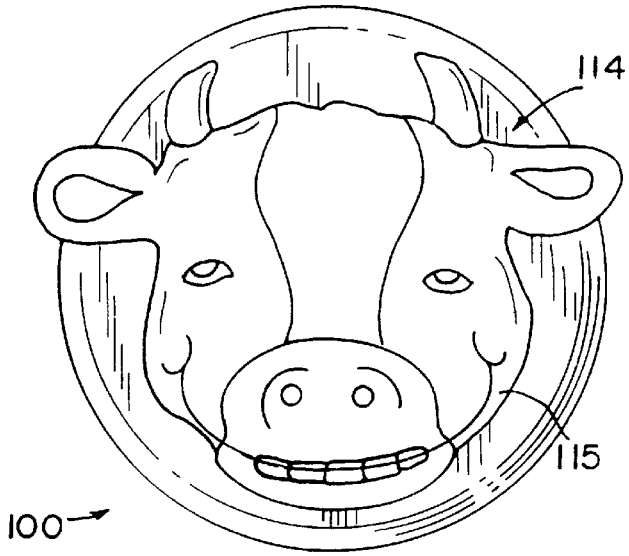
FIG. 8 is a front elevational view of a second magnetic holder of the present invention.
Figure 9:
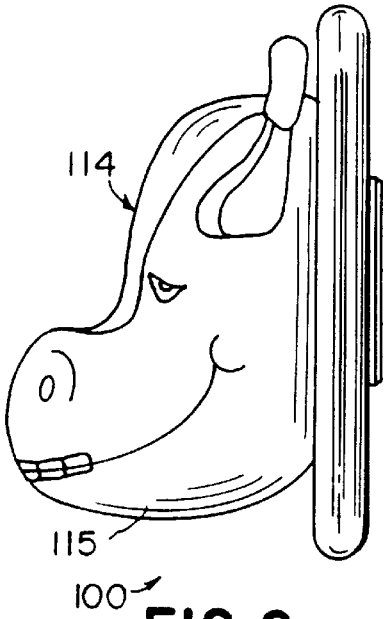
FIG. 9 is a side elevational view of the magnetic holder of FIG. 8 as viewed from the right-hand side thereof.

As seen in FIGS. 8 and 9, a second holder 100 is illustrated. The holder 100 is substantially identical to holder 10 of FIGS. 1–7, except that it has a body 114 having a differently shaped head portion 115.

Head portion 115 of FIGS. 8 and 9 is shaped like a cow, while head portion 15 of FIGS. 1–7 is shaped like a tomato. Various other shaped head portions can be utilized. These differently shaped head portions allow the magnet holder of the present invention to be compatible with the decor of the room where it will be used. Additionally, specific shaped head portions can be used to hold notes for individuals in the household. For example, the tomato-shaped head portion 15 could hold memos for the mother of a family while the bull-shaped head portion 115 could hold memos for the father of the family. Additionally, the head portions may be shaped like everyday objects, such as a mail box that holds stamps.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A magnetic holder comprising:

a magnet, and a flexible and resilient hollow body coupled to the magnet and having a slit therein defining first and second opposed lips normally resiliently biased to a closed condition, the body being responsive to compressive forces applied to predetermined locations thereon for moving the lips to an open condition spaced apart a greater distance than in the closed condition to form an opening in the body.

2. The holder of claim 1, wherein the body is of unitary construction.

3. A magnetic holder comprising:

a magnet, and a flexible and resilient body coupled to the magnet and having a non-planar slit therein defining first and second opposed lips normally resiliently biased to a closed condition, the body being responsive to compressive forces applied to predetermined locations thereon for moving the lips to an open condition spaced apart a greater distance than in the closed condition to form an opening in the body.

4. The holder of claim 3, wherein the slit has first and second ends and a center disposed between and below the first and second ends.

5. The holder of claim 1, wherein the first and second opposed lips contact each other in the closed condition.

6. A magnetic holder comprising:

a magnet, a flexible and resilient body coupled to the magnet and having a slit therein defining first and second opposed lips normally resiliently biased to a closed condition, the body being responsive to compressive forces applied to predetermined locations thereon for moving the lips to an open condition spaced apart a greater distance than in the closed condition to form an opening in the body, the body including a head portion containing the slit and a base portion coupled to the magnet, and a plate coupled to the magnet and disposed in the base portion.

7. The holder of claim 6, wherein the plate is stiffer than the body.

8. The holder of claim 6, wherein the base includes a channel and the plate is disposed in the channel.

9. The holder of claim 8, wherein the plate is disk-shaped and the channel is annular.

10. The holder of claim 1, wherein the slit has a length and the body has a depth, and the ratio of the length of the slit to the depth is less than about 2 to 1.

* * * * *